United States Patent [19]

Nee

[11] Patent Number: 4,470,708

[45] Date of Patent: Sep. 11, 1984

[54] WRIST WATCH

[76] Inventor: Victor W. Nee, 1624 Arcadia Ave., South Bend, Ind. 46635

[21] Appl. No.: 527,670

[22] Filed: Aug. 30, 1983

[51] Int. Cl.[3] ..... G04B 37/00; G04B 19/00

[52] U.S. Cl. ..... 368/276; 368/223; 368/281

[58] Field of Search ..... 368/76, 80, 223, 228, 368/239, 276, 277, 281–282

[56] References Cited

U.S. PATENT DOCUMENTS

| | | | |
|---|---|---|---|
| 2,706,379 | 4/1955 | Fitzpatrick, Jr. | 368/281 |
| 3,977,176 | 8/1976 | Murasami et al. | 368/282 |
| 4,236,239 | 11/1980 | Imgruth et al. | 368/88 |
| 4,283,782 | 8/1981 | Tamana et al. | 368/228 |

*Primary Examiner*—Vit W. Miska

*Attorney, Agent, or Firm*—David Scott Saari

[57] ABSTRACT

An improved wrist watch comprises a watch case having display and/or control components on both the top and the bottom faces of the watch case. Means are provided for the turning of the watch case to access either face and the components mounted thereon.

5 Claims, 6 Drawing Figures

FIG. 1
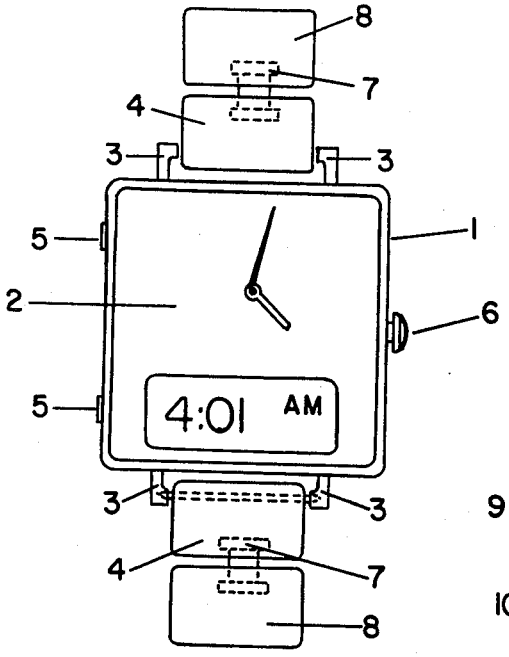
FIG. 2
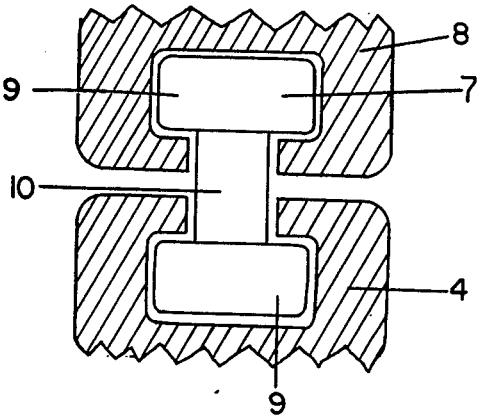
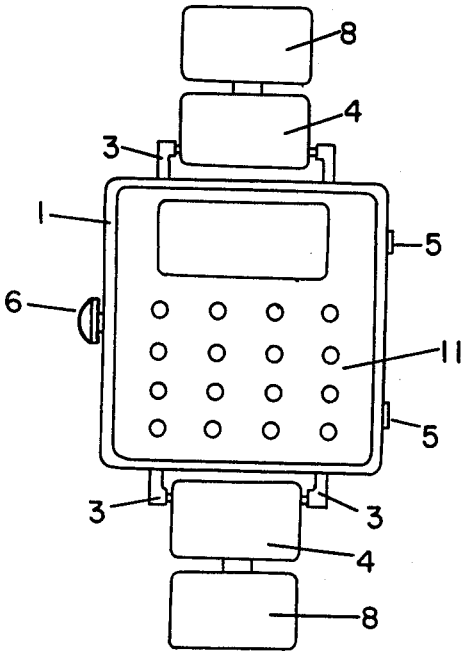
FIG. 3

FIG. 4
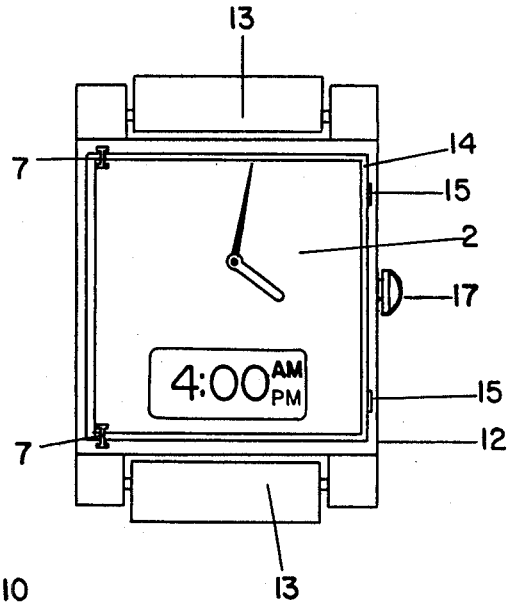
FIG. 5
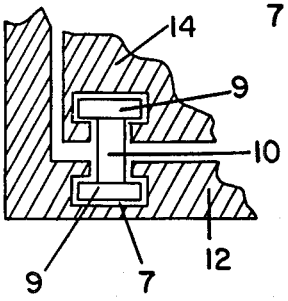
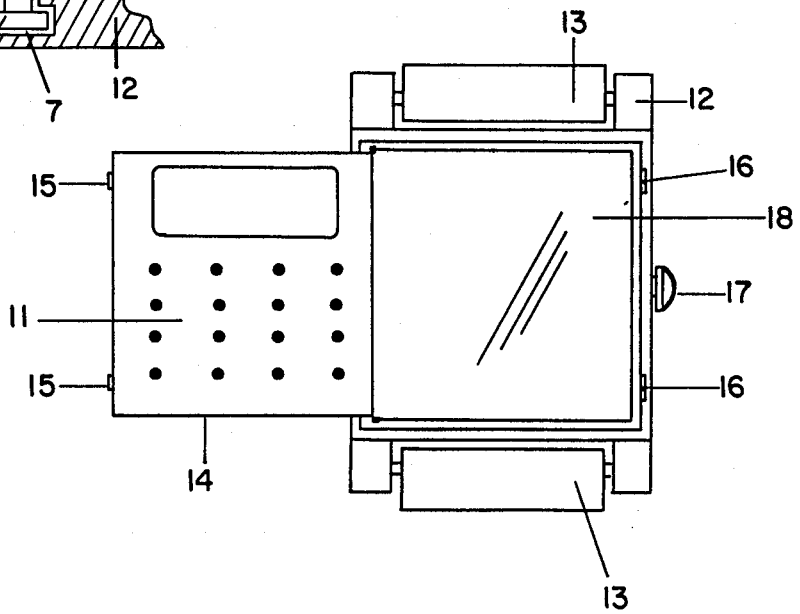
FIG. 6

WRIST WATCH

BACKGROUND OF THE INVENTION

1. Field of the invention.

This invention relates to the fields of wrist watches and wrist watch bands.

2. Description of the prior art.

With the advent of minaturized electronic components, wrist watches which are presently offered for sale in the marketplace can do much more than just indicate the time. Date or calendar functions are common, and some wrist watches may also be used as calculators, stop watches, alarm clocks, and game machines.

The smallness of a wristwatch, especially the thinness, is an important selling feature as most users want the wrist watch to be unobtrusive and comfortable to wear.

Because of the size limitations, it is often the case that one feature must be sacrificed to provide another. For example, it is desirable to have a large display area. If a digital display is used, the numbers must be large enough to read by a quick glance. For an "analog" display, where the traditional hands of a watch are represented by an electronic display, a large area simulating the face of a mechanical wrist watch is needed. Similarly, to display a calendar, a large display area is needed even if the date numerals are small.

On the other hand, the control buttons required for some functions must also be accessable and will compete for space on the wrist watch. On some watches, the control buttons are placed on the sides of the watch; for others, such as a watch that may also be used as a calculator, the control buttons are usually placed on the face of the watch, thus reducing the area available for the display.

To please those who want the sophistication of the various electronic functions yet also wish to tell time by the position of mechanical hands, hybred watches are available.

In some watches, the limited amount of space for, and thus a limited number of, control mechanisms coupled with a relatively large number of functions has produced a watch that is confusing to operate or is difficult to use.

SUMMARY OF THE INVENTION

Among the objects of this invention is to provide a wrist watch which has more surface area for the display of information or for the placement of control mechanisms than present constructions.

A further object of the invention is to provide a wrist watch which is easier to use than present constructions.

The foregoing and other objects of the invention are accomplished by providing a wrist watch which utilizes both the top and the bottom surfaces, as well as a substantial portion of the edges, of the body of the watch for the display of information and for the placement of control mechanisms as described and defined in the specification and as pointed out in the appended claims.

BRIEF DESCRIPTION OF THE DRAWINGS

FIG. 1 is a perspective view of one embodiment of the wrist watch.

FIG. 2 is a partial, sectional view of the hinge mechanism of the watch of FIG. 1.

FIG. 3 is a perspective view of the watch of FIG. 1.

FIG. 4 is a perspective view of a second embodiment of the watch.

FIG. 5 is a partial, sectional view of the hinge mechanism of the watch of FIG. 4.

FIG. 6 is a perspective view of the watch of FIG. 4 in an opened configuration.

DESCRIPTION OF THE PREFERRED EMBODIMENTS

Referring to the drawings, particularly FIG. 1, one embodiment of the watch that I have invented comprises a watch case 1 having a top face 2 and two pair of extensions 3 for attachment to first links 4 of a multilink watchband. For the purpose of illustration only, the top face 2 of the watch is shown to comprise a watch having mechanical hands and a digital date and time display. The construction of these watch components will be familiar to those skilled in the art. One or more controling buttons 5 or knobs 6 may be attached to the sides of the watch case 1.

A first watch band link 4 is constructed to have an aperture and a cavity which contains one end of a link pin 7. The other end of said link pin 7 is contained within a cavity of a second watch band link 8. Link pin 7 comprises two relatively broad stops 9 connected by a relatively narrow rod 10. As illustrated in FIG. 2, the stops 9 have the general shape of a short cylinder; however, said stops 9 could take other forms such as that of a sphere. In general, the stop 9 is larger than the apertures in either watchband links 4 or 8. This construction provides for a means of linking the watchband links 4 and 8. Links 4 and 8 and pin 7 are constructed so as to allow the free rotation of said links about the axis of the central rod 10 of pin 7.

An alternate construction comprises a pin attached to a link, a stop attached to the end of the pin, and a second link having an aperture and a cavity. As in the previous construction, the stop is contained within the cavity and constructed so that the links may be rotated about the axis of the pin.

Not shown, but important for the operation of the invention, the remainder of the watchband, or at least some portion of it, is constructed of expandable links of the type used in watch bands which are designed to be put upon or removed from the wrist by passing over the hand.

When the watch is raised slightly from the wrist and rotated, a second face 11 is revealed. This second face is illustrated in FIG. 3. For the purpose of illustration only, said second face 11 is shown to comprise a calculator display and various calculator control buttons. Thus it may be observed that both faces and a substantial portion of the edges of the watch which I have invented may be used for the display or control components of mechanical or electronic devices.

Optionally, a cover, attached to the watch case 1 by hinge joins, may be placed over the second face 11 to protect the components mounted on that face.

A second embodiment of the watch is illustrated in FIGS. 4 through 6. This embodiment of the watch comprises a case 12 which is attached to a watchband 13. The electronic and mechanical components of the watch are housed in a watch case 14. The two faces 2 and 11 of the case 14 as well as a substantial portion of the edges of the case 14 may be used for display or control components.

The watch case 14 is hinged to case 12 with pins 7. Pins 7 comprise a rod 10 and optionally two stops 9 attached to the ends of rod 10.

A catch mechanism for keeping the watch case 14 within the case 12 is provided; this mechanism comprises a pin 15 attached to the watch case 14 and a pin engaging mechanism 16 built into a recess in case 12. The pin engaging mechanism 16 may be constructed so that the mechanism 16 engages the pin 15, and thus retains the watch case 14 within a space provided for it in case 12, until a user lifts the watch from case 12 to access the second face 11. Alternately, the case 12 may be provided with a controling mechanism 17 that, when pushed or twisted, disengages the mechanism 16 from the pins 15. Other forms of catches known to those familiar with the jeweler's art may be used to hold the watch case 14 into its recess in case 12.

As shown in FIG. 6, the case 12 optionally may be provided with a backplate 18.

In operation, the watch is usually worn with the watch case 12 resting within a recess in case 12. In this configuration, the top face is available for the display of time, date, stopwatch functions, etc. The watch case 14 may be lifted from the recess in case 12 to reveal the second face 11 and any display or control components mounted thereon.

I claim:

1. An improved wrist watch of the type having a watch case, an electrical component, a mechanical component, a controling mechanism, a display component, and an expandable wristband, wherein the improvement comprises a first display component mounted on the top face of a watch case, a second display component mounted on the bottom face of said watch case, a first wristband link attached to said watch case, a second wristband link attached to a wristband, and means for linking said first link to said second link so that said first link may be freely rotated with respect to said second link.

2. An improved wrist watch as recited in claim 1, further comprising a control component mounted on said bottom face of said watch case.

3. An improved wrist watch of the type having a wrist band, a watch case, an electronic component, a mechanical component, a display component, and a control mechanism, wherein the improvement comprises a first display component mounted on the top face of a wrist watch case, a second display component mounted on the bottom face of said watch case, a second case having a recess which is approximately the size and shape of the bottom face of said watch case which is attached to a wristband and which is attached to said watch case with a hinge join so that the watch case may rest within the recess of said second case.

4. An improved wrist watch as recited in claim 3 further comprising a catch mechanism which is attached to said second case and which may engage said first watch case when sid watch case is contained within the recess of said second case.

5. An improved wrist watch as recited in claim 3 further comprising a control mechanism mounted on said bottom face of said watch case.

* * * * *